US011355890B2

(12) United States Patent
Maesoba et al.

(10) Patent No.: US 11,355,890 B2
(45) Date of Patent: Jun. 7, 2022

(54) SHIELD CONNECTOR AND OUTER CONDUCTOR TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/259,888

(22) PCT Filed: Jul. 1, 2019

(86) PCT No.: PCT/JP2019/026033
§ 371 (c)(1),
(2) Date: Jan. 12, 2021

(87) PCT Pub. No.: WO2020/017286
PCT Pub. Date: Jan. 23, 2020

(65) Prior Publication Data

US 2021/0296828 A1 Sep. 23, 2021

(30) Foreign Application Priority Data

Jul. 20, 2018 (JP) ..... JP2018-136695

(51) Int. Cl.
*H01R 13/6581* (2011.01)
*H01R 13/502* (2006.01)
(Continued)

(52) U.S. Cl.
CPC ..... *H01R 13/6581* (2013.01); *H01R 13/502* (2013.01); *H01R 13/629* (2013.01); *H01R 13/639* (2013.01)

(58) Field of Classification Search
CPC ..... H01R 113/6581; H01R 113/502; H01R 113/629; H01R 113/639; H01R 13/6581;
(Continued)

(56) References Cited

U.S. PATENT DOCUMENTS 6,168,467 B1 * 1/2001 Chiou ..... H01R 13/6582 439/607.01
6,210,224 B1 * 4/2001 Wu ..... H01R 13/658 439/607.4
(Continued)

FOREIGN PATENT DOCUMENTS

GB 2257576 A * 1/1993 ..... H01R 13/6594
JP 3056506 U 2/1999
(Continued)

OTHER PUBLICATIONS

International Search Report dated Aug. 6, 2019 for WO 2020/017286 A1 (3 pages).

*Primary Examiner* — Peter G Leigh
(74) *Attorney, Agent, or Firm* — Abelman, Frayne & Schwab

(57) ABSTRACT

It is aimed to provide a shield connector and an outer conductor terminal capable of improving sealing performance and assemblability. An outer conductor terminal includes an outer conductor terminal body having an insertion opening for a dielectric in a rear surface, and a lid
(Continued)

member separate from the outer conductor terminal body and to be mounted into the outer conductor terminal body. The outer conductor terminal body includes a lock receiving portion on each side surface. The lid member includes a back portion for covering the insertion opening, and a pair of side portions connected to the back portion and configured to cover the respective side surfaces of the outer conductor terminal body. Locking portions to be locked to the lock receiving portions are provided on the pair of side portions.

4 Claims, 20 Drawing Sheets

(51) Int. Cl.
*H01R 13/629* (2006.01)
*H01R 13/639* (2006.01)

(58) Field of Classification Search
CPC ... H01R 13/502; H01R 13/629; H01R 13/639
USPC ..... 439/607.01
See application file for complete search history.

(56) References Cited

U.S. PATENT DOCUMENTS

| | | | | |
|---|---|---|---|---|
| 8,668,524 | B2 * | 3/2014 | Lan | H01R 12/724 439/607.35 |
| 10,566,741 | B2 | 2/2020 | Maesoba et al. | |
| 2005/0048839 | A1 * | 3/2005 | Zhang | H01R 13/6582 439/607.56 |
| 2012/0052726 | A1 * | 3/2012 | Lai | H01R 13/6594 439/607.01 |
| 2015/0214670 | A1 * | 7/2015 | Di | H01R 13/506 439/607.55 |
| 2017/0294727 | A1 * | 10/2017 | Tsai | H01R 13/6585 |
| 2018/0151988 | A1 * | 5/2018 | Zhao | H01R 13/6585 |
| 2018/0175560 | A1 * | 6/2018 | Zhang | H01R 12/71 |

FOREIGN PATENT DOCUMENTS

| | | |
|---|---|---|
| JP | 2000-012165 A | 1/2000 |
| JP | 2008-192474 A | 8/2008 |

* cited by examiner

SHIELD CONNECTOR AND OUTER CONDUCTOR TERMINAL

CROSS REFERENCE TO RELATED APPLICATIONS

This application is a national phase of PCT application No. PCT/JP2019/026033, filed on 1 Jul. 2019, which claims priority from Japanese patent application No. 2018-136695, filed on 20 Jul. 2018, all of which are incorporated herein by reference.

TECHNICAL FIELD

The present disclosure relates to a shield connector and an outer conductor terminal.

BACKGROUND

A shield connector disclosed in Patent Document 1 includes an inner conductor terminal (terminal fitting), a dielectric for accommodating the inner conductor terminal and an outer conductor terminal (outer conductor) for accommodating a dielectric module composed of the inner conductor terminal and the dielectric. The outer conductor terminal includes an insertion opening in a rear surface and integrally includes a lid portion configured to be displaced to an opening position and a closing position via a hinge (boundary line) connected to an opening edge of the insertion opening. The dielectric module is inserted into a module accommodating portion of the outer conductor terminal when the lid portion is at the opening position.

On the other hand, a shield connector disclosed in Patent Document 2 includes an inner conductor terminal, a dielectric for accommodating the inner conductor terminal and an outer conductor terminal for accommodating the dielectric, and the outer conductor terminal includes a lid body separate from an outer conductor terminal body and configured to cover a dielectric insertion opening in a rear surface.

PRIOR ART DOCUMENT

Patent Document

Patent Document 1: JP 2018-006152A
Patent Document 2: JP 2008-192474A

SUMMARY OF THE INVENTION

Problems to be Solved

In the case of Patent Document 1, since the outer conductor terminal includes the hinge in a coupled part of the lid portion, the inside of a loose part of the hinge and cut parts on both sides across the hinge become clearances and noise in the form of a high frequency signal may leak out or intrude through these clearances to impair shielding performance. Further, it has been difficult to perform an operation of inspecting a solder-connected state of the terminal fitting to a circuit board due to the presence of the lid portion.

On the other hand, in the case of Patent Document 2, since the entire dielectric insertion opening can be covered by the separate lid body, shielding performance can be improved and the lid body could be mounted after the connected state of the terminal fitting was inspected. However, since the lid body of Patent Document 2 is box-shaped and merely fit to a rear part of the outer conductor terminal body from outside, there has been a concern that the lid body is removed from the outer conductor terminal body.

Accordingly, it is aimed to provide a shield connector and an outer conductor terminal capable of improving shielding performance and assemblability.

Means to Solve the Problem

The present disclosure is directed to a shield connector with an inner conductor terminal, a dielectric for accommodating the inner conductor terminal, and an outer conductor terminal for accommodating the dielectric, wherein the outer conductor terminal includes an outer conductor terminal body having an insertion opening for the dielectric in a rear surface, and a lid member separate from the outer conductor terminal body and to be mounted into the outer conductor terminal body, the outer conductor terminal body includes a lock receiving portion on each side surface, and the lid member includes a back portion for covering the insertion opening, a pair of side portions connected to the back portion and configured to cover the respective side surfaces of the outer conductor terminal body, and locking portions provided on the pair of side portions and to be locked to the lock receiving portions.

Effect of the Invention

According to the present disclosure, it is possible to provide a shield connector and an outer conductor terminal capable of improving shielding performance and assemblability.

DETAILED DESCRIPTION TO EXECUTE THE INVENTION

Description of Embodiments of Present Disclosure

Figure 1:
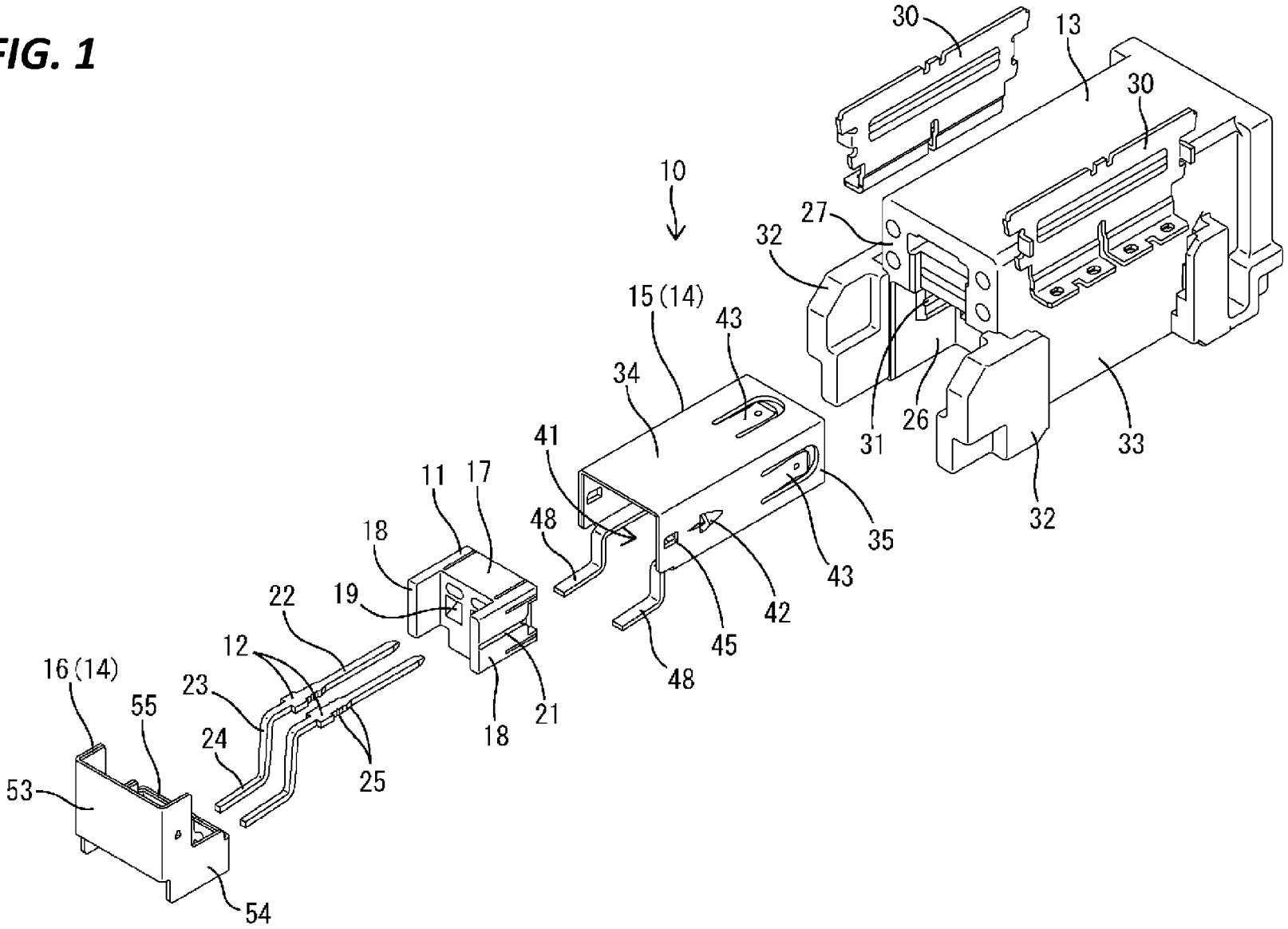
FIG. 1 is an exploded perspective view of a shield connector of a first embodiment viewed obliquely from an upper-rear side.

First, embodiments of the present disclosure are listed and described.

(1) The shield connector of the present disclosure includes an inner conductor terminal, a dielectric for accommodating the inner conductor terminal, and an outer conductor terminal for accommodating the dielectric, wherein the outer conductor terminal includes an outer conductor terminal body having an insertion opening for the dielectric in a rear surface, and a lid member separate from the outer conductor terminal body and to be mounted into the outer conductor terminal body, the outer conductor terminal body includes a lock receiving portion on each side surface, and the lid member includes a back portion for covering the insertion opening, a pair of side portions connected to the back portion and configured to cover the respective side surfaces of the outer conductor terminal body, and locking portions provided on the pair of side portions and to be locked to the lock receiving portions.

If the separate lid member is used, shielding performance can be improved since the back portion can cover the entire insertion opening of the outer conductor terminal body. Further, the lid member can be mounted into the outer conductor terminal body after a state of solder connection or the like of a terminal fitting is inspected. Furthermore, by locking the locking portions of the pair of side portions to the lock receiving portions on the respective side surfaces of the outer conductor terminal body, the lid member can be stably mounted in the outer conductor terminal body and the removal thereof from the outer conductor terminal body can be prevented.

(2) The outer conductor terminal body may include a second lock receiving portion on a surface other than the respective side surfaces, and the lid member may include a covering portion for covering the surface of the outer conductor terminal body other than the respective side surfaces and a second locking portion provided on the covering portion and to be locked to the second lock receiving portion. By locking the second locking portion of the covering portion to the second lock receiving portion, the lid member is more stably mounted in the outer conductor terminal body.

(3) The covering portion may be provided to extend between the pair of side portions. If the side portions are cantilevered from the back portion, there is a concern that the side portions are deformed with coupled parts to the back portion as fulcrums and the locking portions may be disengaged from the lock receiving portions. However, according to the above configuration, since the covering portion is provided to extend between the pair of side portions, the deformation of the side portions can be prevented by the covering portion and a state where the locking portions are locked to the lock receiving portions can be satisfactorily maintained.

Details of Embodiments of Present Disclosure

Hereinafter, specific examples of the shield connector and the outer conductor terminal of the present disclosure are described with reference to the drawings. Note that the present invention is not limited to these illustrations and is intended to be represented by claims and include all changes in the scope of claims and in the meaning and scope of equivalents.

First Embodiment

A first embodiment is described with reference to FIGS. 1 to 18. A shield connector 10 of the first embodiment is a connector for automotive high speed communication and, as shown in FIG. 3, mounted on a surface of a circuit board 90. As shown in FIG. 1, the shield connector 10 includes a dielectric 11 made of synthetic resin, inner conductor terminals 12 made of conductive metal, a housing 13 made of synthetic resin and an outer conductor terminal 14 made of conductive metal. The outer conductor terminal 14 is composed of an outer conductor terminal body 15 and a lid member 16 (separate member) separate from the outer conductor terminal body 15. Note that, in the following description, a right side of FIG. 3, which is a surface side to be connected to an unillustrated mating connector, is defined as a front side concerning a front-rear direction, and a lower side of FIG. 3, which is a surface side to be placed on the circuit board 90, is defined as a lower side concerning a vertical direction.

(Dielectric 11)

Figure 9:
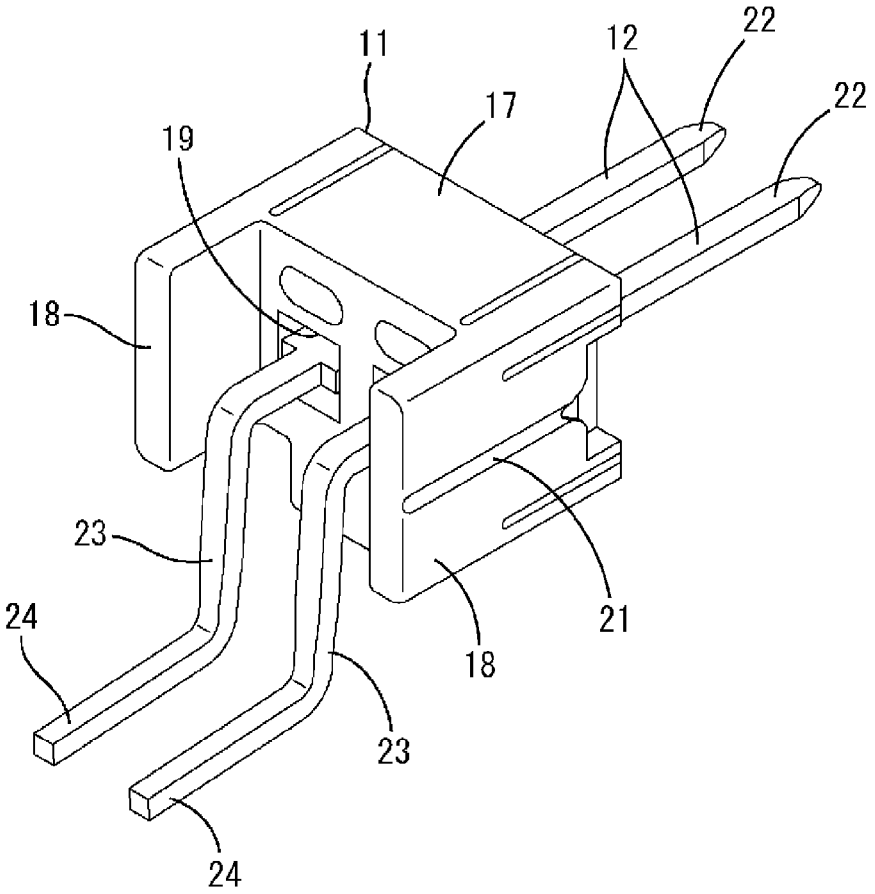
FIG. 9 is a perspective view of a dielectric having each inner conductor terminal mounted therethrough and viewed obliquely from an upper-rear side.
Figure 11:
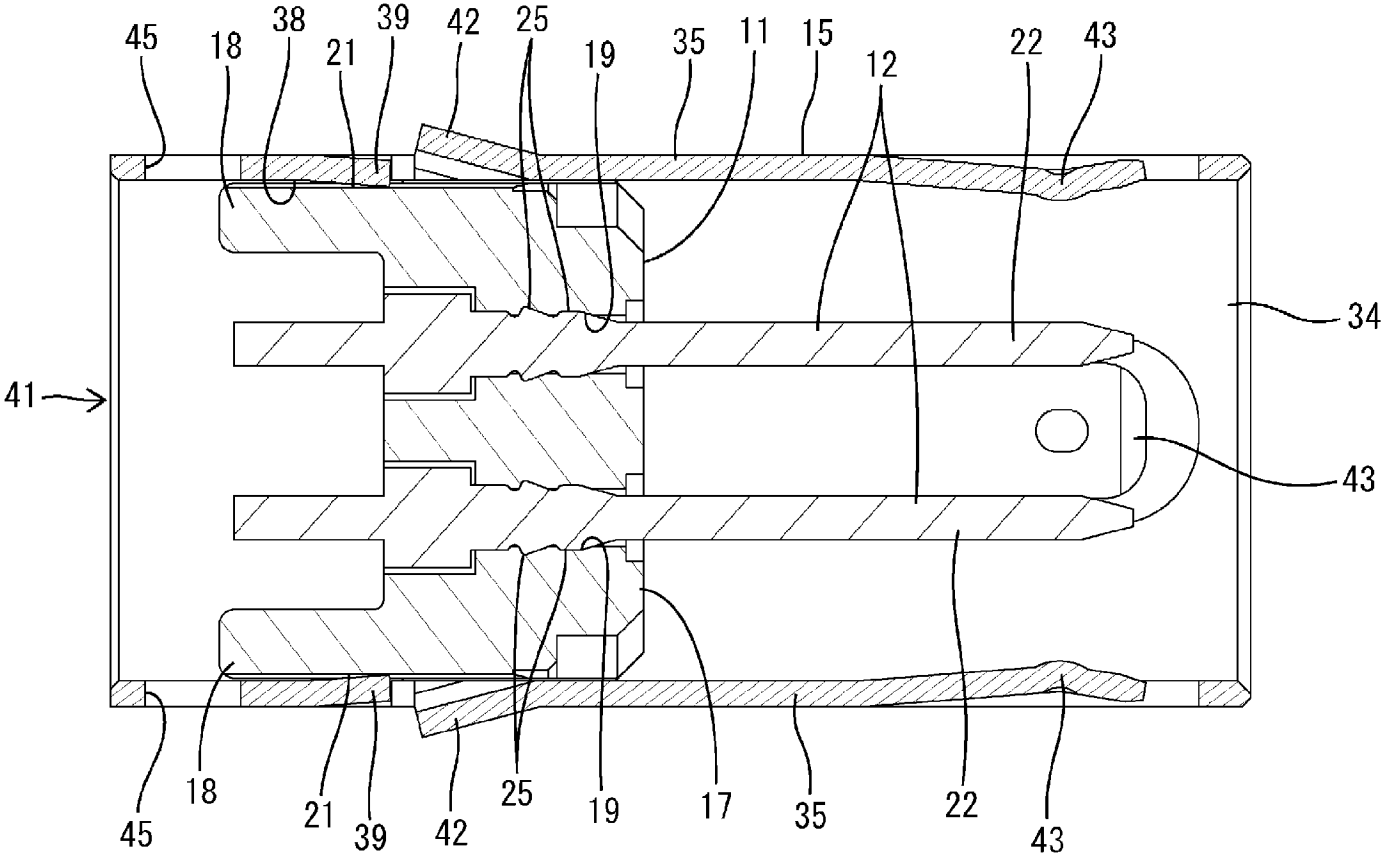
FIG. 11 is a bottom view in section showing the state of FIG. 10.
Figure 12:
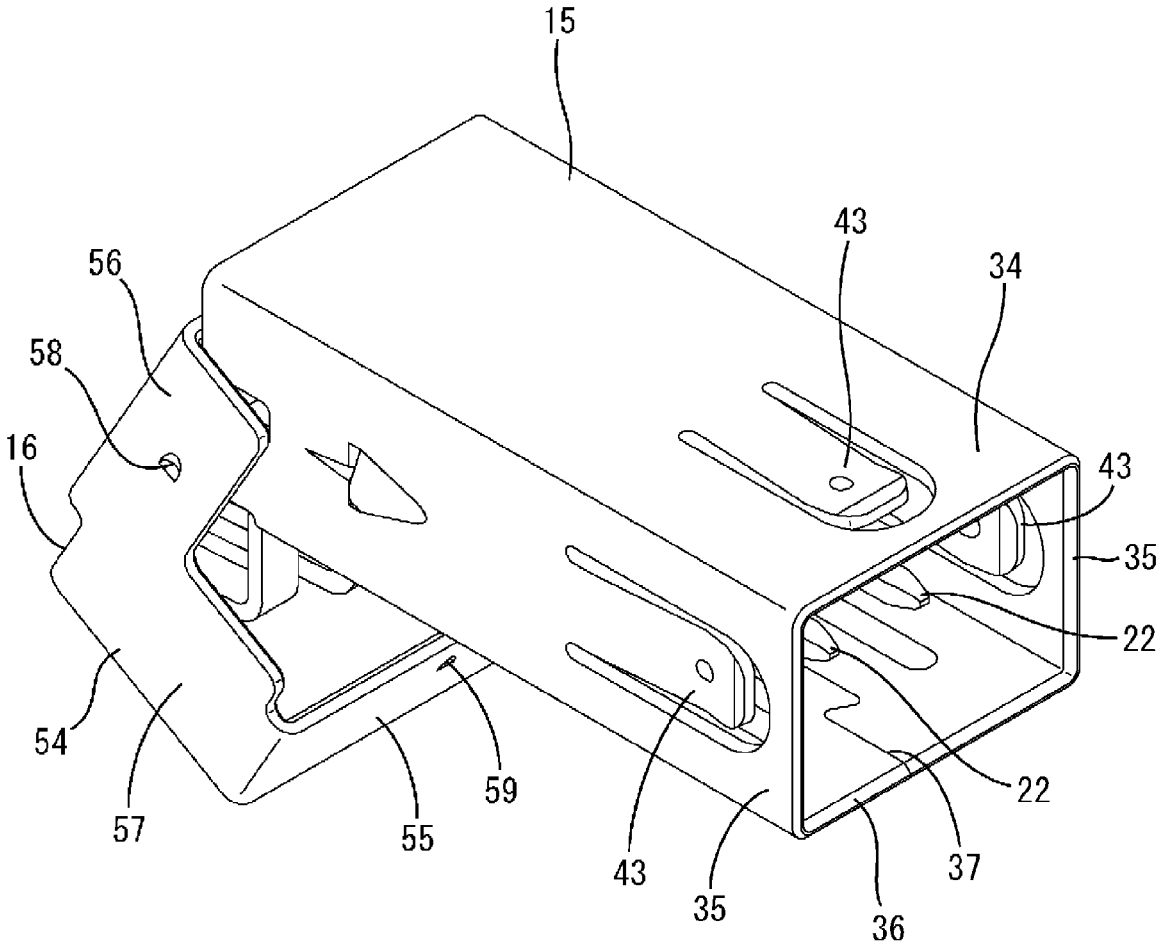
FIG. 12 is a perspective view, viewed obliquely from an upper-front side, showing a state in the process of mounting the lid member into the outer conductor terminal body.

As shown in FIGS. 1 and 9, the dielectric 11 includes a dielectric body 17 in the form of a rectangular block and a pair of guide portions 18 projecting rearward from both sides of the dielectric body 17. The dielectric body 17 includes a plurality of mounting holes 19 penetrating in the front-rear direction inside. As shown in FIG. 11, the respective mounting holes 19 are provided laterally side by side in pair. The respective guide portions 18 include a pair of groove-like dielectric locking portions 21 (only one is shown in FIGS. 1 and 9) in outer surfaces.

(Inner Conductor Terminals 12)

As shown in FIG. 1, the inner conductor terminal 12 includes a horizontal first connecting portion 22 extending in the front-rear direction, a second connecting portion 23 extending downward from the rear end of the first connecting portion 22 and a third connecting portion 24 extending rearward from the lower end of the second connecting portion 23. A front part of the first connecting portion 22 is connected to an unillustrated female terminal fitting mounted in the mating connector at the time of connection to the mating connector. The first connecting portion 22 includes a plurality of projections 25 projecting toward both lateral sides.

Figure 17:
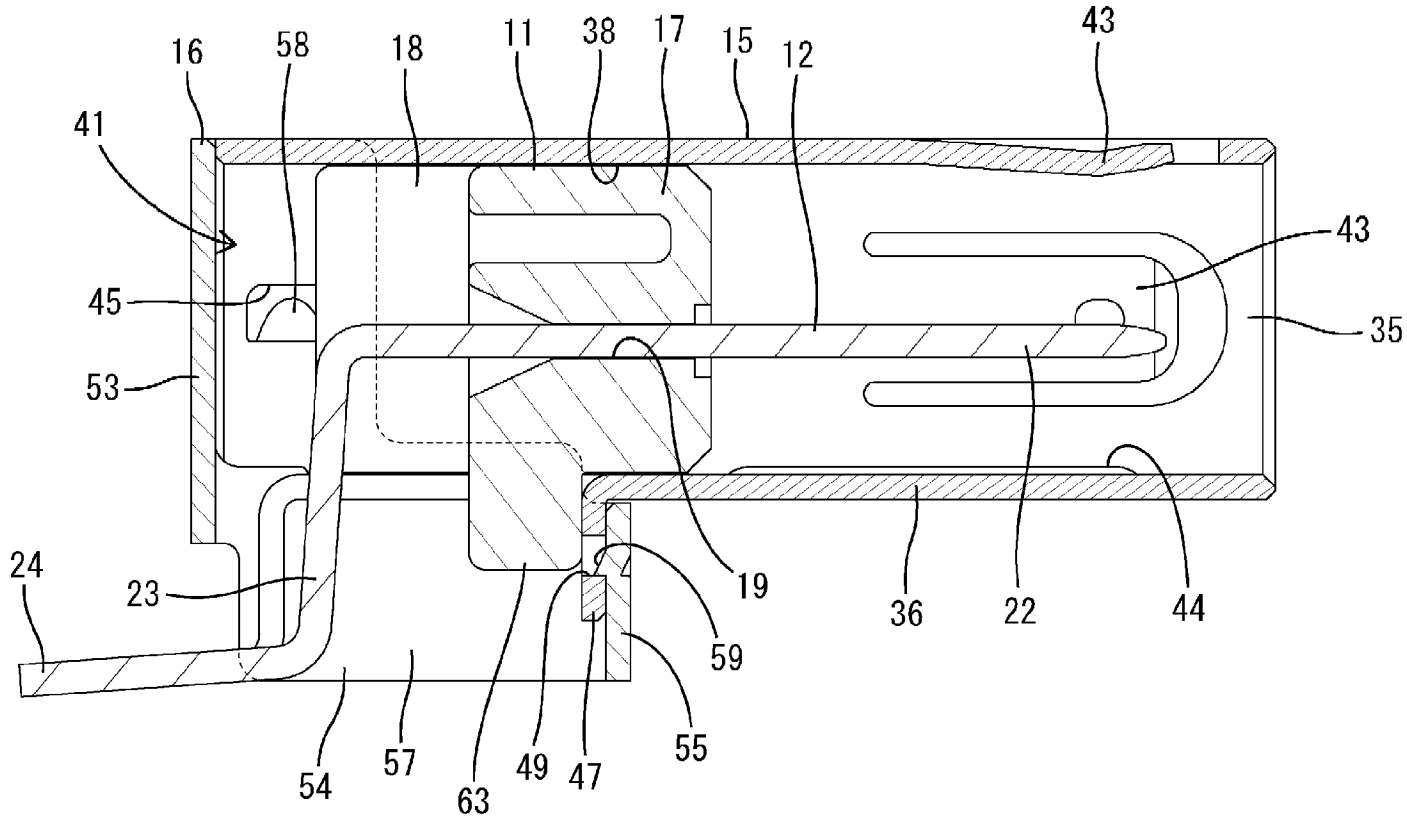
FIG. 17 is a side view in section showing the state of FIG. 14.
Figure 18:
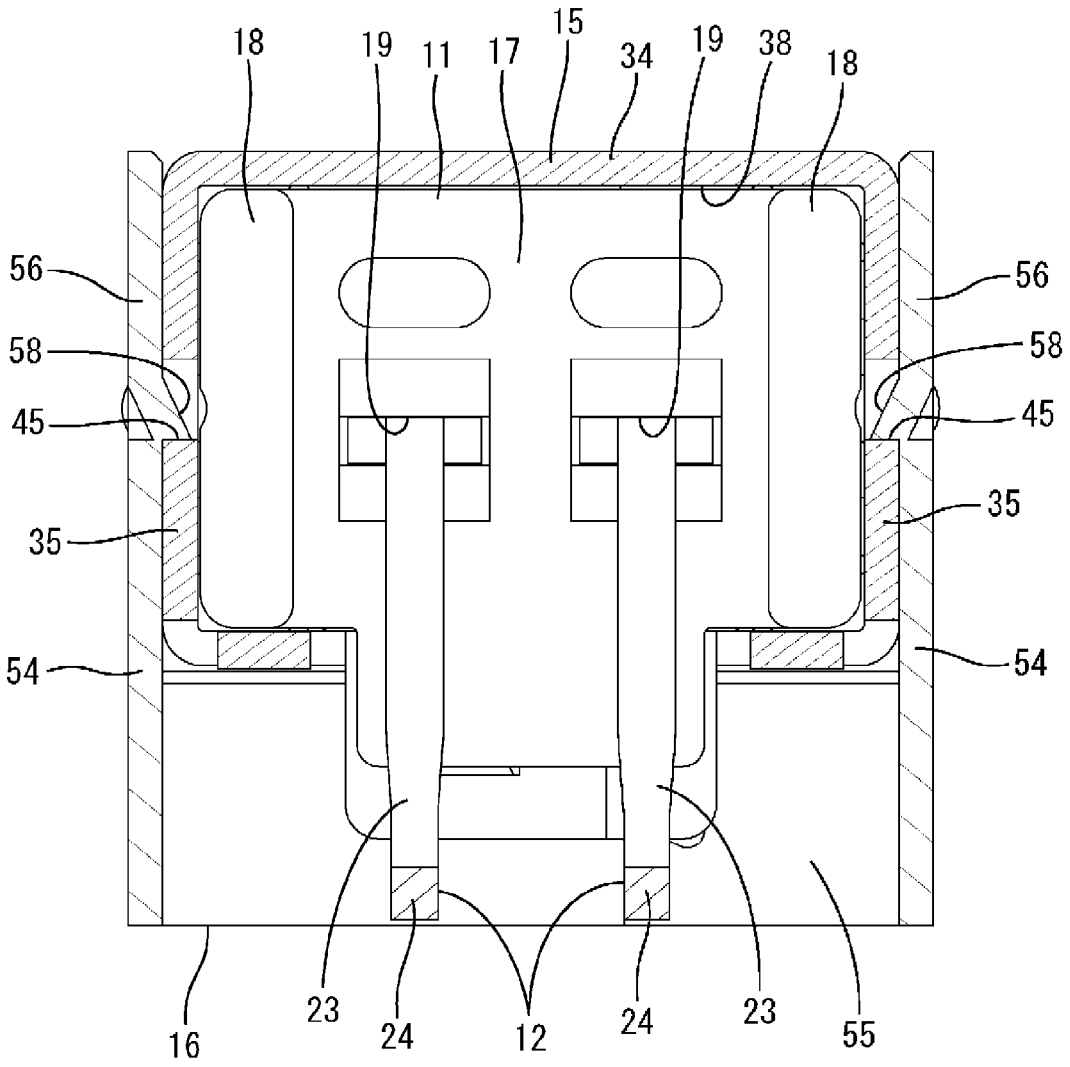
FIG. 18 is a rear view in section showing the state of FIG. 14.

As shown in FIG. 11, the first connecting portion 22 is inserted into the mounting hole 19 of the dielectric body 17 and the respective projections 25 are locked to bite into both side surfaces of the mounting hole 19, whereby the inner conductor terminal 12 is retained and mounted in the dielectric 11. As shown in FIGS. 9 and 17, with the inner conductor terminal 12 mounted through the dielectric 11, the front part of the first connecting portion 22 projects forward from the dielectric 11 and a rear part of the first connecting portion 22, the second connecting portion 23 and the third connecting portion 24 are arranged to be exposed rearward from the dielectric 11. As shown in FIG. 3, the third connecting portion 24 is arranged along the surface of the circuit board 90 and soldered and connected to a conductive path on the surface of the circuit board 90.

(Housing 13)

As shown in FIG. 3, the housing 13 includes a housing base portion 27 having a terminal accommodating portion 26, and a receptacle 28 projecting forward from the housing base portion 27. The mating connector is fittable into the receptacle 28, and the receptacle 28 includes a lock portion 29 for locking the mating connector on the front end of the inner surface of an upper wall.

The terminal accommodating portion 26 has a rectangular cross-sectional shape, penetrates through the housing base portion 27 in the front-rear direction, and is open in the lower surface of the housing base portion 27. The housing base portion 27 includes a pair of outer conductor lock receiving portions 31 (only one is shown in FIG. 1) on both side surfaces of the terminal accommodating portion 26. The housing base portion 27 is configured such that the outer conductor terminal body 15 can be accommodated into the terminal accommodating portion 26.

Figure 2:
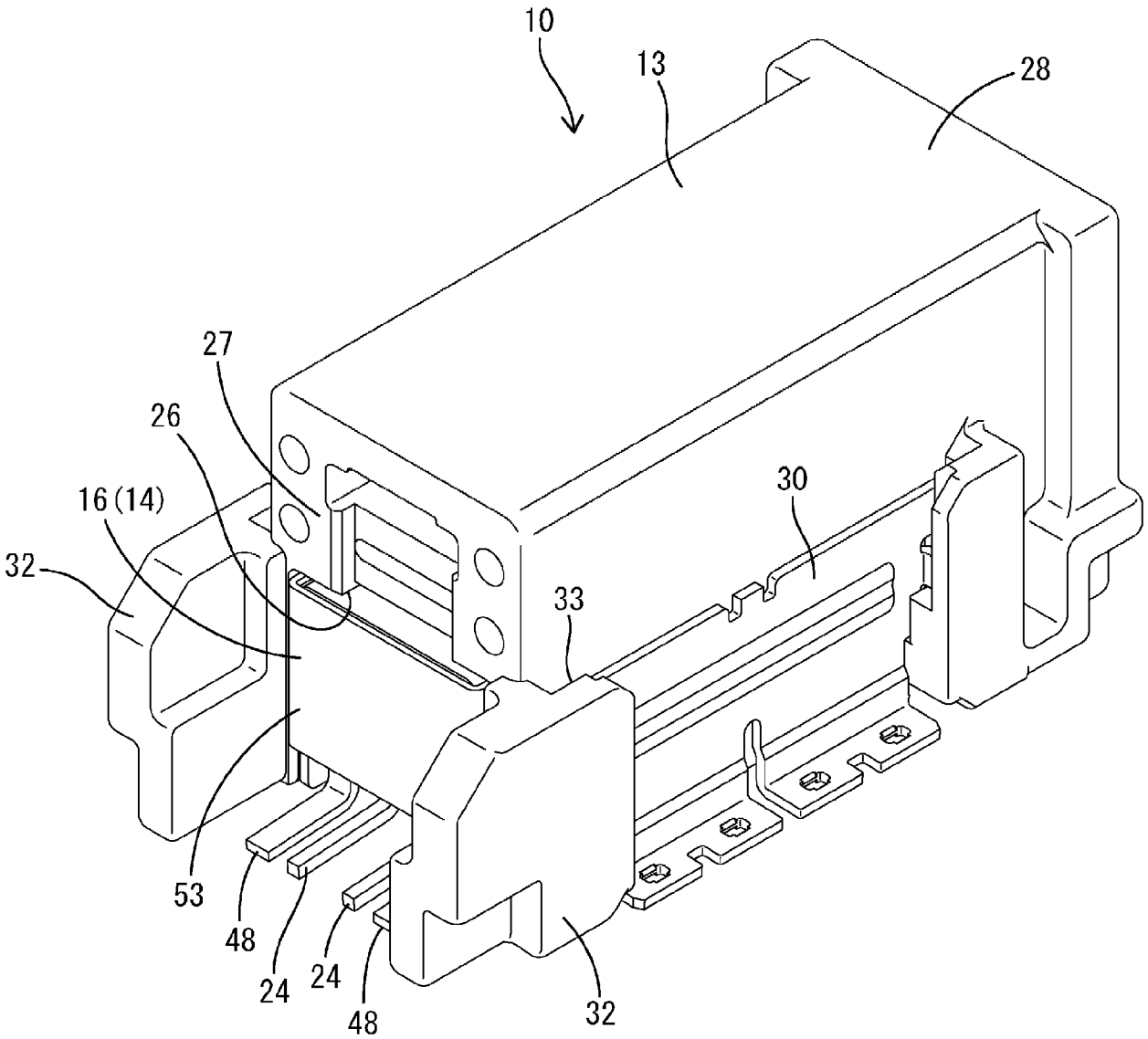
FIG. 2 is a perspective view of the shield connector viewed obliquely from an upper-rear side.
Figure 3:
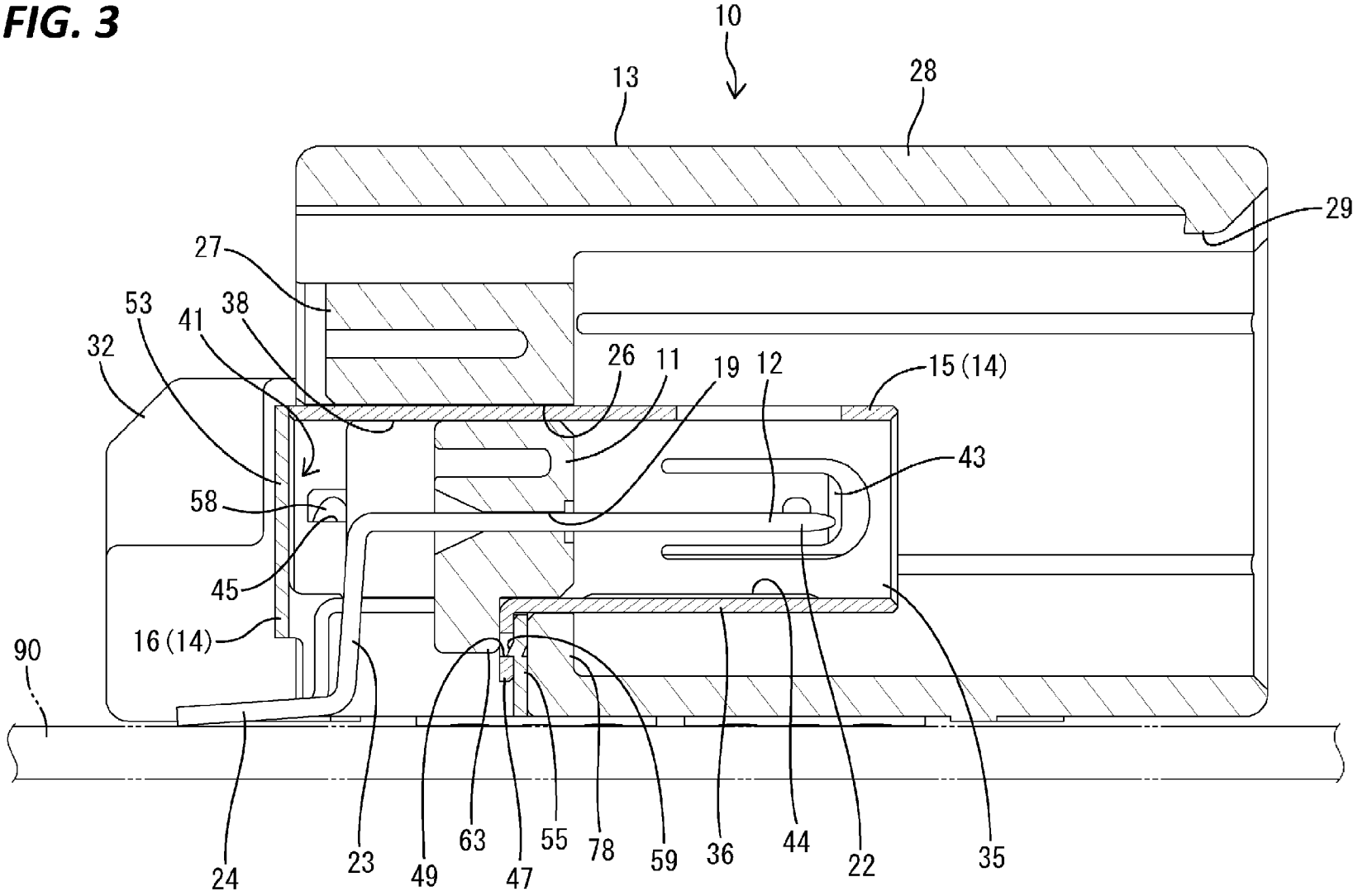
FIG. 3 is a side view in section of the shield connector.

As shown in FIGS. 1 and 2, the housing base portion 27 includes a pair of protection walls 32 projecting rearward on both sides. With the outer conductor terminal body 15 inserted in the terminal accommodating portion 26, the third connecting portions 24 of the respective inner conductor terminals 12 project rearward from the terminal accommodating portion 26 and the respective protection walls 32 are located on both sides across projecting parts of the third connecting portions 24, whereby the respective inner conductor terminals 12 can be protected.

The housing 13 includes a pair of fixture mounting grooves 33 (only one is shown in FIG. 1) in parts of both side surfaces straddling the housing base portion 27 and the receptacle 28. The rear ends of the respective fixture mounting grooves 33 are defined by the respective protection walls 32. The housing 13 is soldered and fixed to the surface of the circuit board 90 via fixtures 30 press-fit into the respective fixture mounting grooves 33 from above. Note that the fixtures 30 are plate members made of metal.

(Outer Conductor Terminal Body 15)

Figure 4:
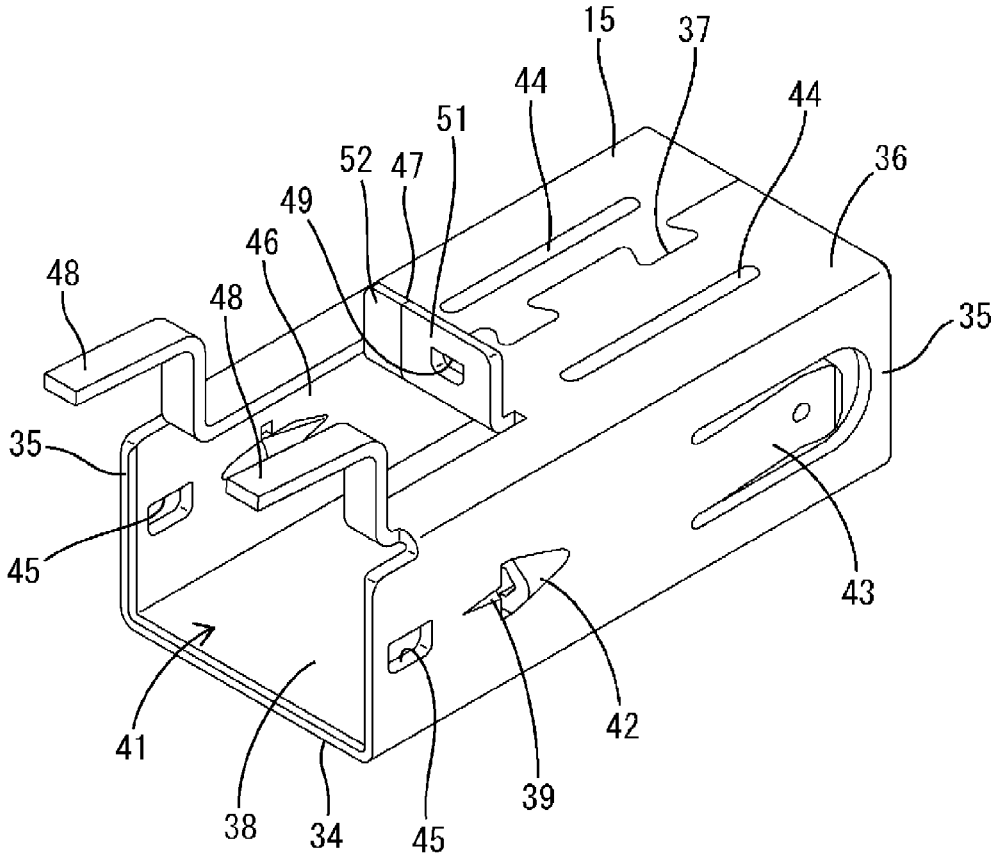
FIG. 4 is a perspective view of an outer conductor terminal body inverted and viewed obliquely from an upper-rear side.
Figure 5:
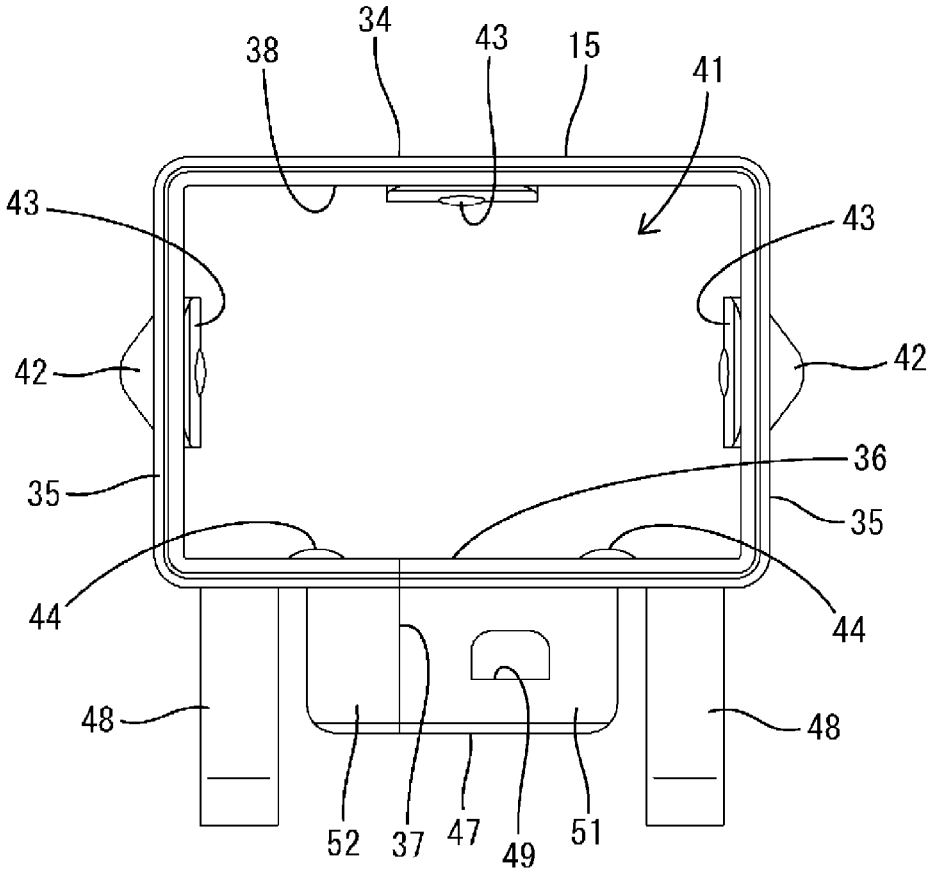
FIG. 5 is a front view of the outer conductor terminal body.

The outer conductor terminal body 15 is formed by, after stamping one flat plate base material by a press, bending the stamped piece into a predetermined shape. As shown in FIGS. 4 and 5, the outer conductor terminal body 15 includes a ceiling plate portion 34, a pair of side plate portions 35 and a bottom plate portion 36. The ceiling plate portion 34 and the bottom plate portion 36 are facing each other in the vertical direction, and the respective side plate portions 35 are facing each other in a width direction (lateral direction). As shown in FIG. 4, the bottom plate portion 36 includes mating end parts 37 in a widthwise central part. The outer conductor terminal body 15 can be prevented from opening and maintain a box shape thereof by engaging a dovetail projection and a dovetail recess of the mating end parts 37 of the bottom plate portion 36.

The outer conductor terminal body 15 includes a dielectric accommodating portion 38 penetrating in the front-rear direction in an internal space defined by the ceiling plate portion 34, the respective side plate portions 35 and the bottom plate portion 36. The dielectric accommodating portion 38 has a rectangular cross-section and includes, as shown in FIG. 11, a pair of dielectric lock receiving portions 39 formed by striking both side surfaces to project inward. An opening in the rear surface of the dielectric accommodating portion 38 is configured as an insertion opening 41 for inserting the dielectric 11 into the dielectric accommodating portion 38. The dielectric 11 is retained and held in the dielectric accommodating portion 38 by the dielectric locking portions 21 being resiliently locked to the dielectric lock receiving portions 39.

Figure 6:
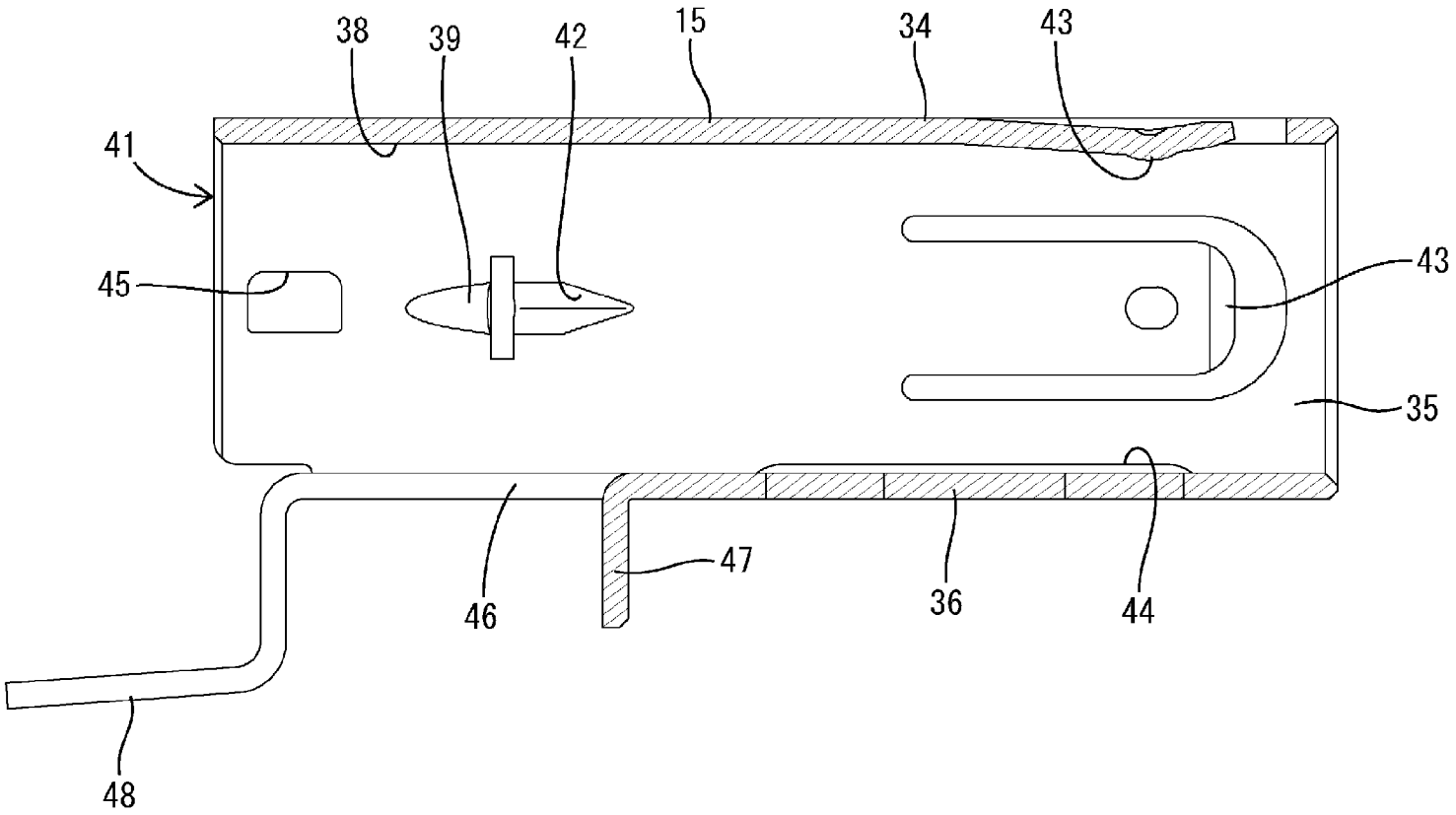
FIG. 6 is a side view in section of the outer conductor terminal body.

The outer conductor terminal body 15 includes a pair of outer conductor locking portions 42 formed by striking the respective side plate portions 35 to project outward. As shown in FIGS. 4 and 6, the outer conductor locking portions 42 and the dielectric lock receiving portions 39 are provided side by side in the front-rear direction in the side plate portions 35. The outer conductor terminal body 15 is retained and held in the terminal accommodating portion 26 of the housing 13 by the outer conductor locking portions 42 being resiliently locked to the outer conductor lock receiving portions 31 of the housing 13.

The outer conductor terminal body 15 includes resilient contact pieces 43 bent inward in U-shaped cuts in front parts of the respective side plate portions 35 and a front part of the ceiling plate portion 34, and a pair of embossed portions 44 extending in the front-rear direction in parallel on a side of the bottom plate portion 36 facing the resilient contact pieces 43 of the ceiling plate portion 34 (see FIG. 5). If the outer conductor terminal body 15 is connected to the mating female terminal fitting, the respective embossed portions 44 come into contact with a mating outer conductor terminal of the female terminal fitting, the respective resilient contact pieces 43 resiliently contact the mating outer conductor terminal and the both terminal fittings are shield-connected.

As shown in FIG. 4, the outer conductor terminal body 15 includes a pair of lock receiving portions 45 in rear parts of the respective side plate portions 35. Each lock receiving portion 45 is a hole penetrating through the side plate portion 35 in a thickness direction and, as shown in FIG. 6, has a rectangular opening shape having a lower edge extending straight along the front-rear direction. Two upper corner parts of each lock receiving portion 45 are arcuately rounded, and two lower corner parts thereof are right-angled. As shown in FIG. 6, the lock receiving portion 45 is located in a vertically central part of the side plate portion 35 and arranged side by side with the resilient contact piece 43, the outer conductor locking portion 42 and the dielectric lock receiving portion 39 of the side plate portion 35 at the same height.

As shown in FIGS. 4 and 6, the outer conductor terminal body 15 includes a cut portion 46, which communicates with the dielectric accommodating portion 38 and is open downward and rearward, in a rear part of the bottom plate portion 36. Further, the outer conductor terminal body 15 includes a plate-like projecting piece 47 rectangular in a front view and bent to extend downward from a front end part of the cut portion 46, and a pair of connecting pieces 48 L-shaped in a side view, extending downward from a rear end part of the bottom plate portion 36 on both sides across the cut portion 46 and bent to extend rearward. Rearward extending parts of the respective connecting pieces 48 are arranged along the surface of the circuit board 90 and soldered and connected to a shield circuit of the circuit board 90.

As shown in FIGS. 4 and 5, the projecting piece 47 includes a large area portion 51 and a small area portion 52 on both sides across the mating end parts 37, and a second lock receiving portion 49 in a central part of the large area portion 51, out of these. The second lock receiving portion 49 is a hole penetrating through the projecting piece 47 in a thickness direction, has a rectangular opening shape having a lower edge extending straight along the front-rear direction and has substantially the same shape as each lock receiving portion 45.

(Lid Member 16)

Figure 7:
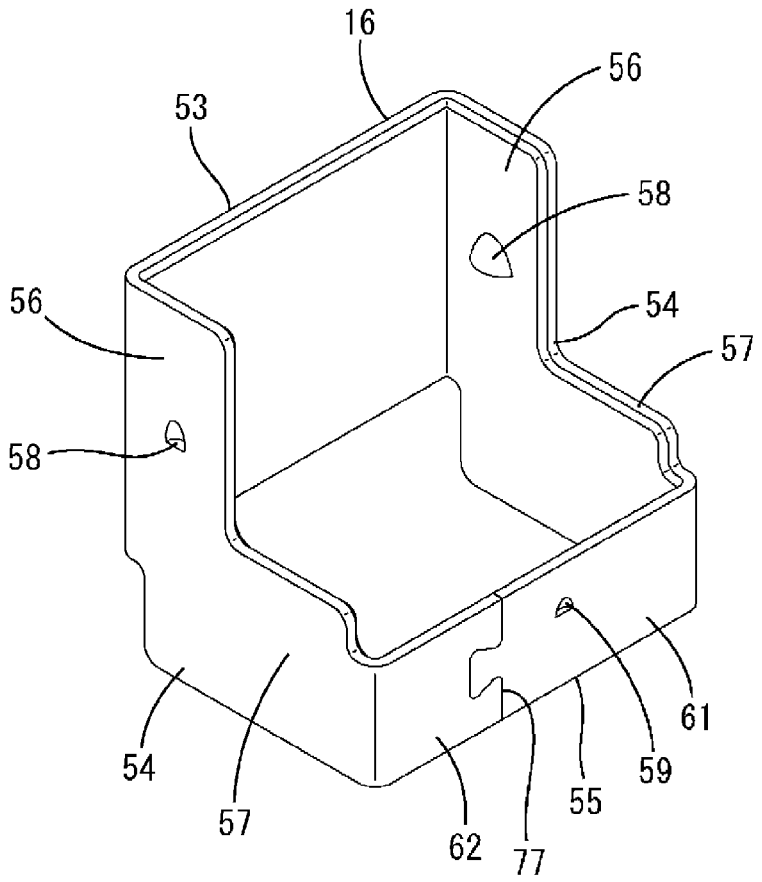
FIG. 7 is a perspective view of a lid member viewed obliquely from an upper-front side.
Figure 8:
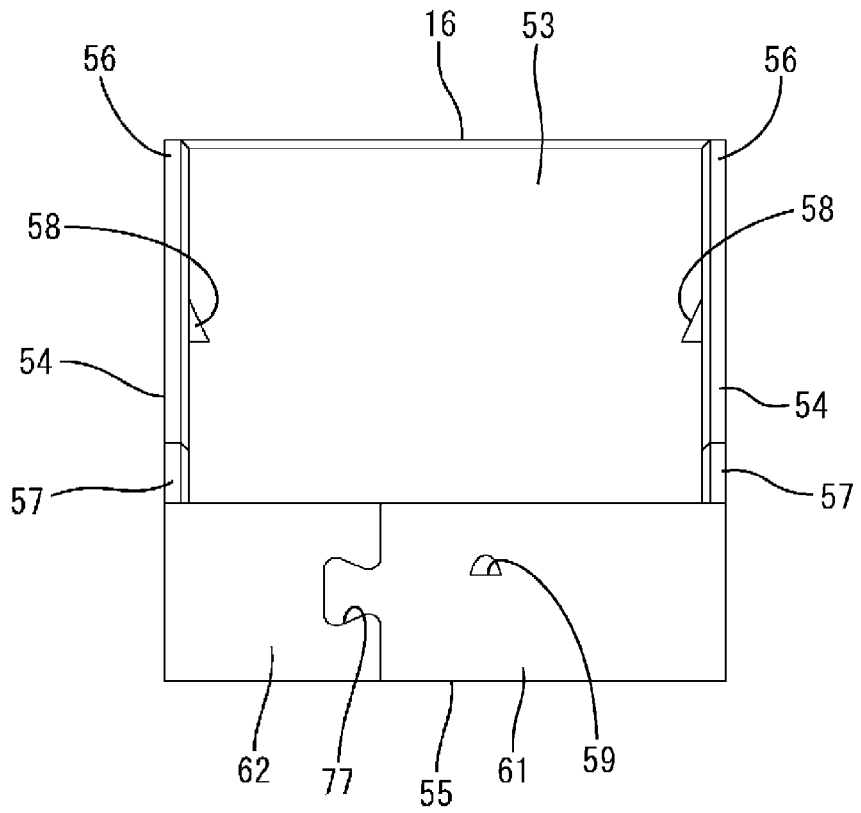
FIG. 8 is a front view of the lid member.

The lid member 16 is formed by, after stamping one flat plate base material by a press, bending the stamped piece into a predetermined shape, similarly to the outer conductor terminal body 15. As shown in FIGS. 7 and 8, the lid member 16 integrally includes a back portion 53 extending along the vertical direction and the width direction and rectangular in a back view, a pair of side portions 54 projecting forward from both side ends of the back portion 53 and extending along the vertical direction and the front-rear direction, and a covering portion 55 provided to extend between the front ends of the pair of side portions 54, and has a frame shape rectangular in a plan view.

The back portion 53 has flat plate surfaces having no projection and no recess in the front-rear direction, and is of such a size as to cover the entire insertion opening 41 of the outer conductor terminal body 15 (see FIG. 17).

Figure 14:
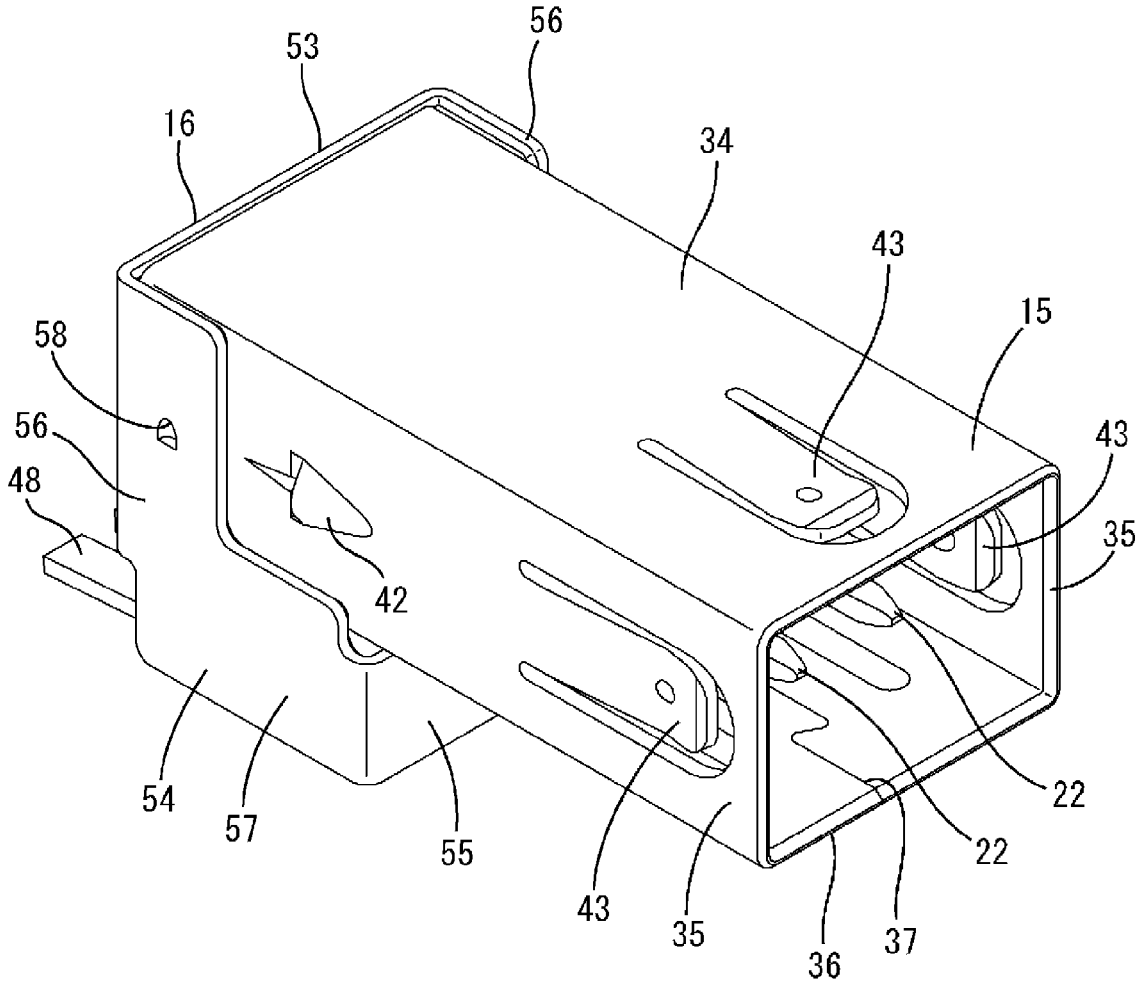
FIG. 14 is a perspective view, viewed obliquely from an upper-front side, showing a state where the lid member is mounted in the outer conductor terminal body.
Figure 15:
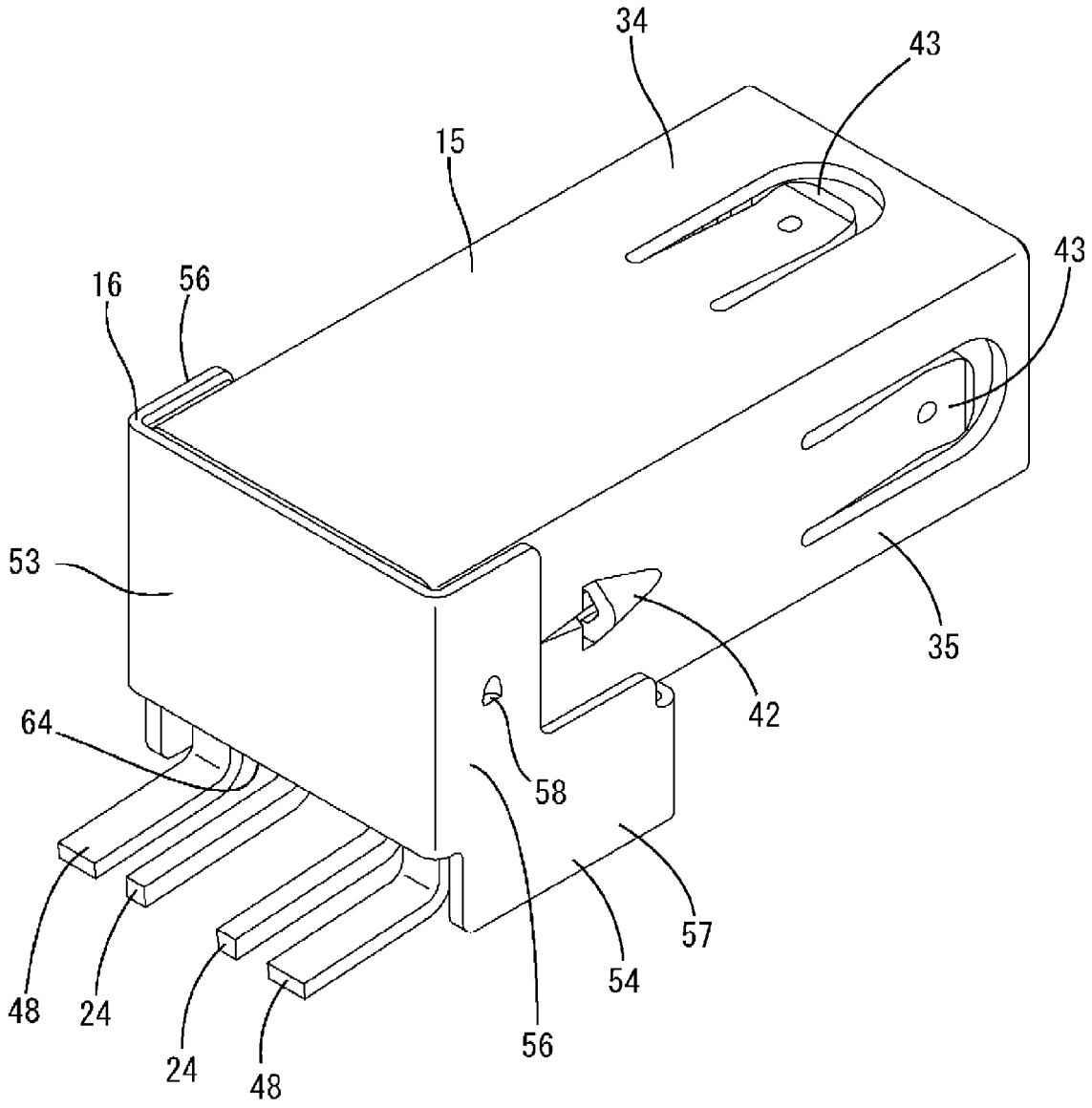
FIG. 15 is a perspective view, viewed obliquely from an upper-rear side, showing the state of FIG. 14.
Figure 16:
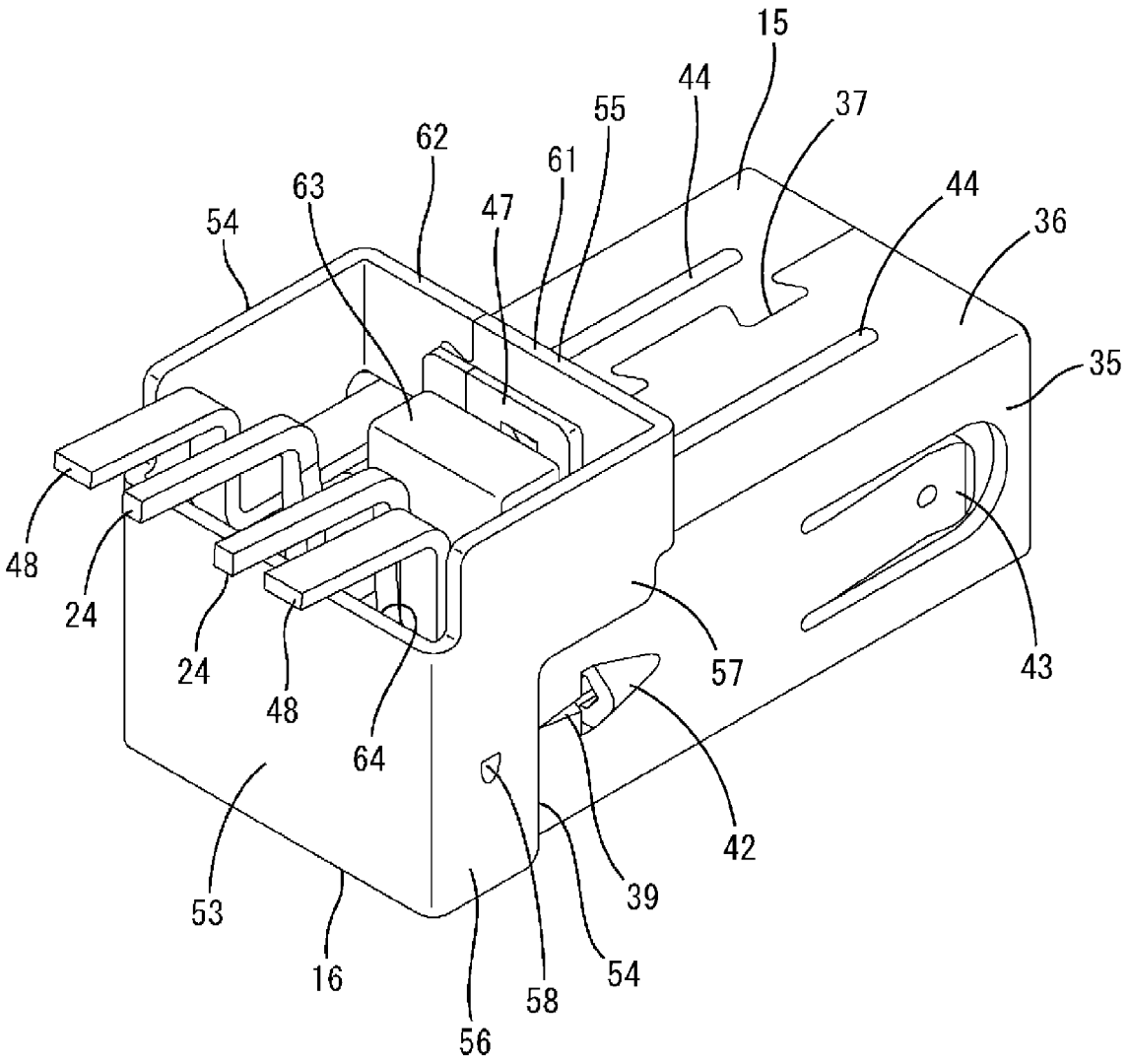
FIG. 16 is a perspective view showing the state of FIG. 14 inverted and viewed obliquely from an upper-rear side.

The respective side portions 54 are connected to the both side ends of the back portion 53 over an entire height, and arranged to intersect (in particular, perpendicular to) the plate surfaces of the back portion 53. As shown in FIG. 7, each side portion 54 is L-shaped by cutting one corner on a front end upper part, and includes a first piece 56 having a vertically long rectangular shape in a side view and projecting forward from the corresponding side end of the back portion 53 and a second piece 57 having a laterally long rectangular shape in a side view, connected to the lower end of the first piece and projecting forward. The second piece 57 is mostly located below the back portion 53. As shown in FIGS. 14 to 16, the first pieces 56 of the respective side portions 54 can cover rear parts of the outer surfaces (side surfaces) of the respective side portions 35 of the outer conductor terminal body 15. The second pieces 57 of the respective side portions 54 can cover lower parts and the like of the second connecting portions 23 of the respective inner conductor terminals 12 from both sides (see FIG. 17).

As shown in FIG. 8, the respective side portions 54 include a pair of locking portions 58 formed by striking the first pieces 56 and projecting inward. Each locking portion 58 has a triangular shape in front and back views, has a horizontally arranged lower end and is obliquely arranged from an upper end toward a projecting end to be tapered. Further, each locking portion 58 is formed by recessing the outer surface of the first piece 56 of each side portion 54, and continuous with a surrounding part of the first piece 56 without any cut (see FIG. 18).

As shown in FIGS. 7 and 8, the covering portion 55 is arranged along the vertical direction and the width direction similarly to the back portion 53. The covering portion 55 and the back portion 53 are arranged to face each other with a step formed therebetween. The covering portion 55 includes a long portion 61 and a short portion 62 bent from the rear ends of the second pieces 57 of the respective side portions 54 to extend inward, and mating edge parts 77 in the form of a dovetail projection and a dovetail recess of the long portion 61 and the short portion 62 are engaged, whereby the lid member 16 can be prevented from opening and the frame shape thereof can be maintained. An extension amount (length) of the long portion 61 from the second piece 57 is larger than that of the short portion 62 from the second piece 57.

Figure 13:
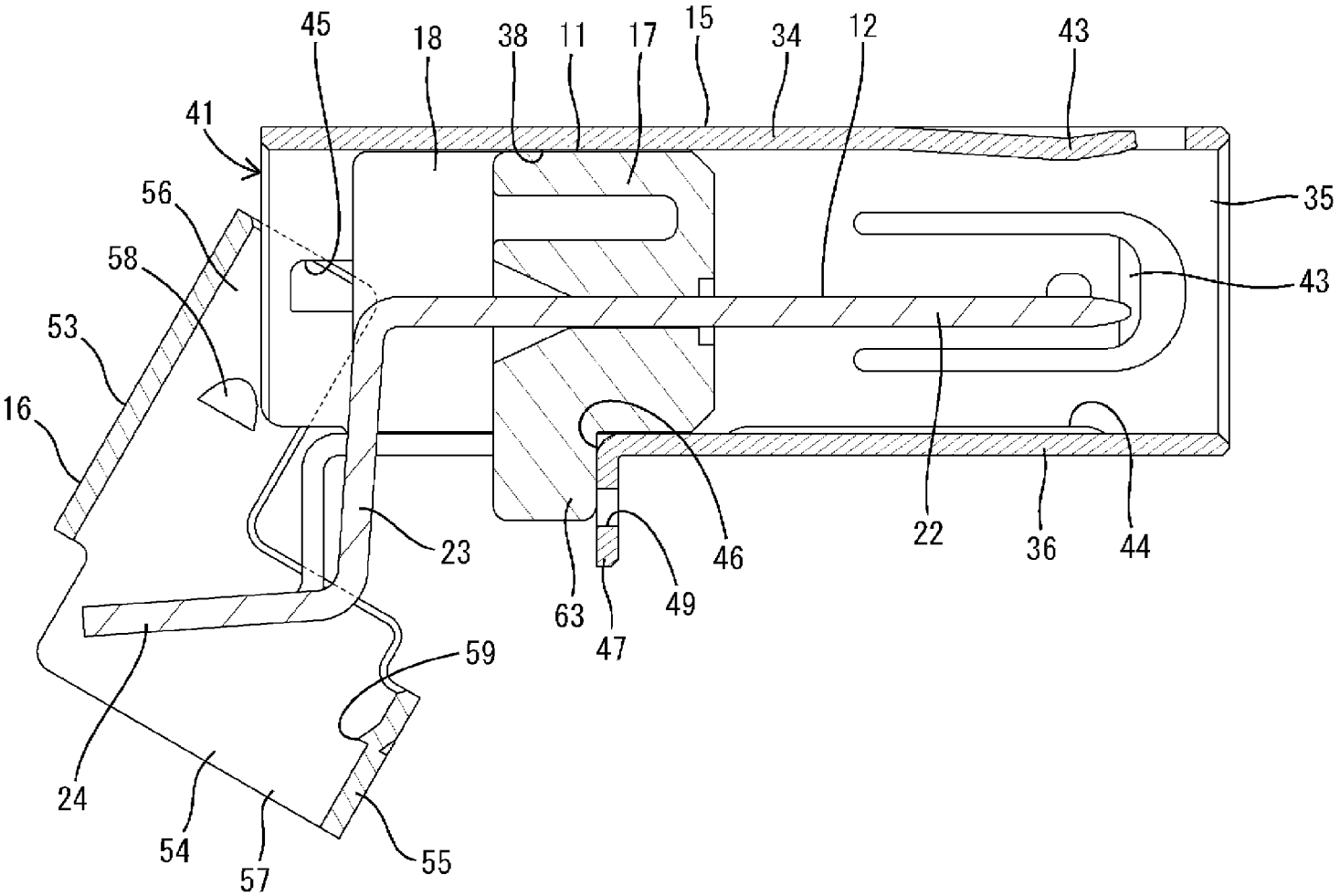
FIG. 13 is a side view in section showing the state of FIG. 12.

The covering portion 55 includes a second locking portion 59 struck to project inward. As shown in FIGS. 13 and 17, the second locking portion 59 has a triangular shape in a side view, has a horizontally arranged lower edge and is obliquely arranged from an upper end to a projecting end. Further, the second locking portion 59 is formed by recessing the outer surface (front surface) of the long portion 61, and continuous without any cut in a surrounding part of the long portion 61. In short, the second locking portion 59 has substantially the same shape as the locking portion 58.

(Manufacturing Method of Shield Connector 10)

Figure 10:
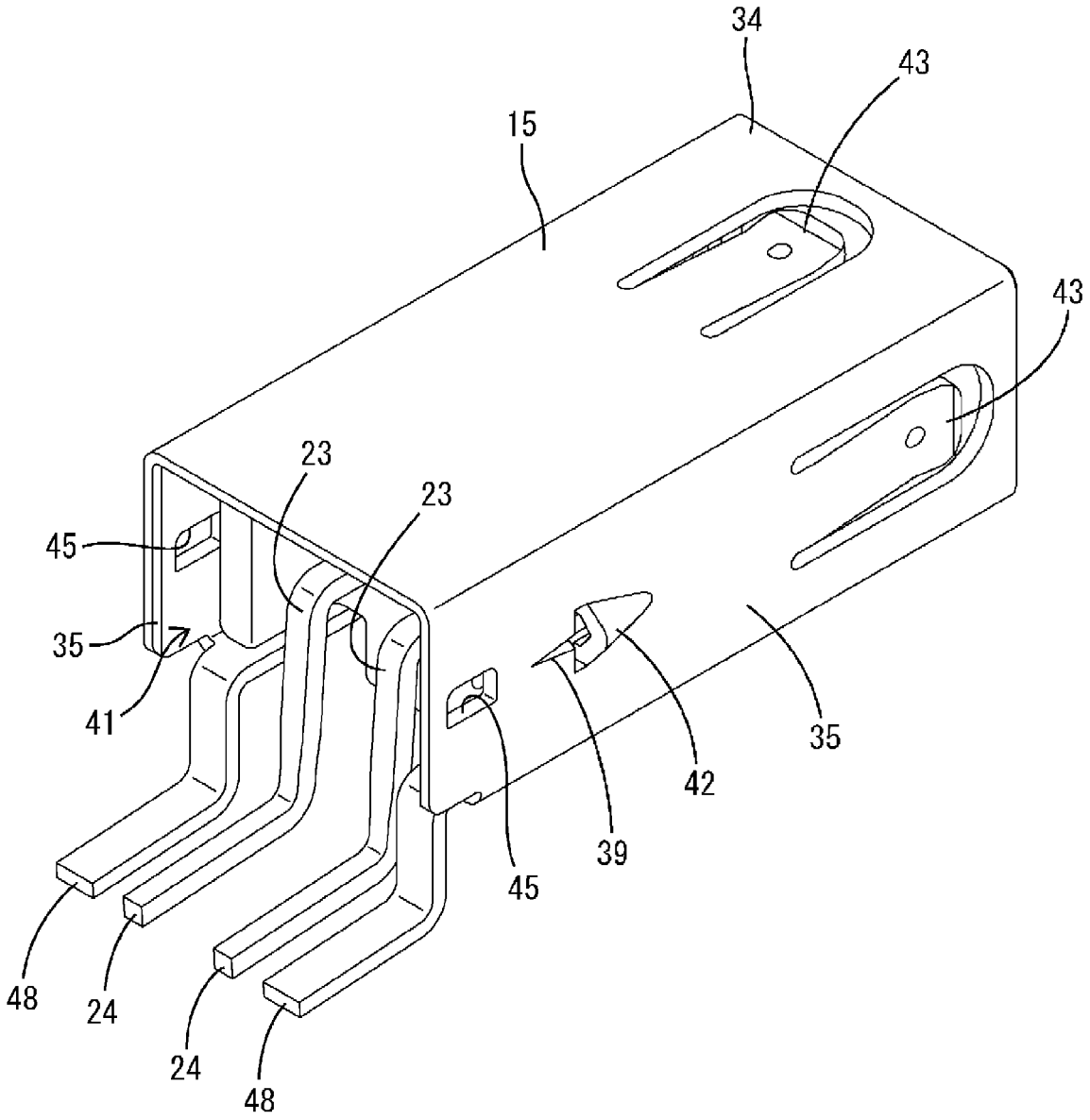
FIG. 10 is a perspective view, viewed obliquely from an upper-rear side, showing a state where the dielectric is accommodated in the outer conductor terminal body and each inner conductor terminal is pulled out from the dielectric.

In assembling the shield connector 10, the inner conductor terminals 12 are first mounted through the respective mounting holes 19 of the dielectric 11 as shown in FIG. 9. Subsequently, as shown in FIG. 11, the dielectric 11 is inserted into the dielectric accommodating portion 38 of the outer conductor terminal body 15 through the insertion opening 41, and retained and mounted in the outer conductor terminal body 15 by the locking of the respective dielectric locking portions 21 and the respective dielectric lock receiving portions 39. Further, as shown in FIG. 13, the dielectric 11 is stopped in front in the dielectric accommodating portion 38 of the outer conductor terminal body 15 by a step portion 63 projecting in a lower part of the dielectric 11 entering the cut portion 46 of the outer conductor terminal body 15 and coming into contact with the rear surface of the projecting piece 47. With the dielectric 11 mounted in the outer conductor terminal body 15, parts of the respective inner conductor terminals 12 from the second connecting portions 23 to the third connecting portions 24 are exposed from the dielectric accommodating portion 38 and arranged side by side with the respective connecting pieces 48 located on both sides as shown in FIG. 10. Further, as shown in FIG. 11, front parts of the first connecting portions 22 of the respective inner conductor terminals 12 are arranged to project into the outer conductor terminal body 15.

Subsequently, the lid member 16 is arranged below a rear part of the outer conductor terminal body 15. In that state, the lid member 16 is inclined to tilt the first pieces 56 forward and the first pieces 56 are arranged to slightly cover the outer surfaces of the side plate portions 35 of the outer conductor terminal body 15 as shown in FIG. 13. Subsequently, the lid member 16 is rotated into a proper mounting posture to displace the covering portion 55 to a front-upper side. Then, as shown in FIG. 17, the respective locking portions 58 of the lid member 16 reach positions corresponding to the respective lock receiving portions 45 of the outer conductor terminal body 15 and are fit and resiliently locked to the respective lock receiving portions 45. Along with that, the covering portion 55 of the lid member 16 covers the front surface of the projecting piece 47 of the outer conductor terminal body 15, the second locking portion 59 of the lid member 16 reaches a position corresponding to the second lock receiving portion 49 of the outer conductor terminal body 15, and the second locking portion 59 is fit and resiliently locked to the second lock receiving portion 49. In this way, the lid member 16 is retained and stably and reliably mounted in the outer conductor terminal body 15 by the locking of the respective locking portions 58 and the respective lock receiving portions 45 and the locking of the second locking portion 59 and the second lock receiving portion 49. With the lid member 16 mounted in the outer conductor terminal body 15, the second connecting portions 23 of the respective inner conductor terminals 12 and vertically extending parts of the respective connecting pieces 48 are covered from both sides by the second pieces 57 of the respective side portions 54 and covered from front by the covering portion 55.

Further, with the lid member 16 mounted in the outer conductor terminal body 15, the back portion 53 covers and closes the entire insertion opening 41 of the outer conductor terminal body 15 and, as shown in FIGS. 15 and 16, the third connecting portions 24 of the respective inner conductor terminals 12 and parts of the respective connecting pieces 48 extending in the front-rear direction are arranged to be exposed rearward from the lower end of the back portion 53. There is a height difference between the back portion 53 and the second pieces 57 of the respective side portions 54, and lower parts of the second connecting portions 23 of the respective inner conductor terminals 12 and the vertically extending parts of the respective connecting pieces 48 are also arranged to be partially exposed in a stepped space 64 formed due to that height difference.

Thereafter, the outer conductor terminal body 15 is inserted into the terminal accommodating portion 26 of the housing 13 from behind, and the outer conductor terminal body 15 and consequently the outer conductor terminal 14 are retained and mounted in the housing 13 by the locking of the respective outer conductor terminal locking portions 42 and the respective outer conductor lock receiving portions 31. As shown in FIG. 3, the outer conductor terminal 14 is stopped in front in the terminal accommodating portion 26 of the housing 13 by the contact of the covering portion 55 with the rear surface of a wall portion 78 defining the front end of the terminal accommodating portion 26 in the housing 13.

As described above, according to the first embodiment, the lid member 16 separate from the outer conductor terminal body 15 is mounted into the outer conductor terminal body 15 and the entire insertion opening 41 of the outer conductor terminal body 15 is covered and closed by the back portion 53 of the lid member 16. Thus, the formation of a clearance in the outer conductor terminal 14 can be prevented and shielding performance can be improved.

Further, even if the lid member 16 is a separate body, the lid member 16 is retained and held in the outer conductor terminal body 15 by the locking of the respective locking portions 58 and the respective lock receiving portions 45. Thus, the lid member 16 is not inadvertently removed from the outer conductor terminal body 15. As a result, assembly reliability can be enhanced.

Further, the outer conductor terminal body 15 is configured such that the second lock receiving portion 49 is open in the front surface of the projecting piece 47, which is a surface other than the outer surfaces of the respective side plate portions 35 in which the respective lock receiving portions 45 are open, the lid member 16 includes the covering portion 55 for covering the front surface of the projecting piece 47, and the covering portion 55 includes the second locking portion 59 to be resiliently locked to the second lock receiving portion 49. Thus, the lid member 16 is held in the outer conductor terminal body 15 with higher reliability by the locking of the second locking portion 59 and the second lock receiving portion 49 in addition to the locking of the respective locking portions 58 and the respective lock receiving portions 45.

Furthermore, since the covering portion 55 is integrally provided to extend between the pair of side portions 54, the respective side portions 54 are prevented from being deformed with coupled parts to the back portion 53 as fulcrums and a state where the respective locking portions 58 are locked to the respective lock receiving portions 45 is satisfactorily maintained.

Second Embodiment

Figure 19:
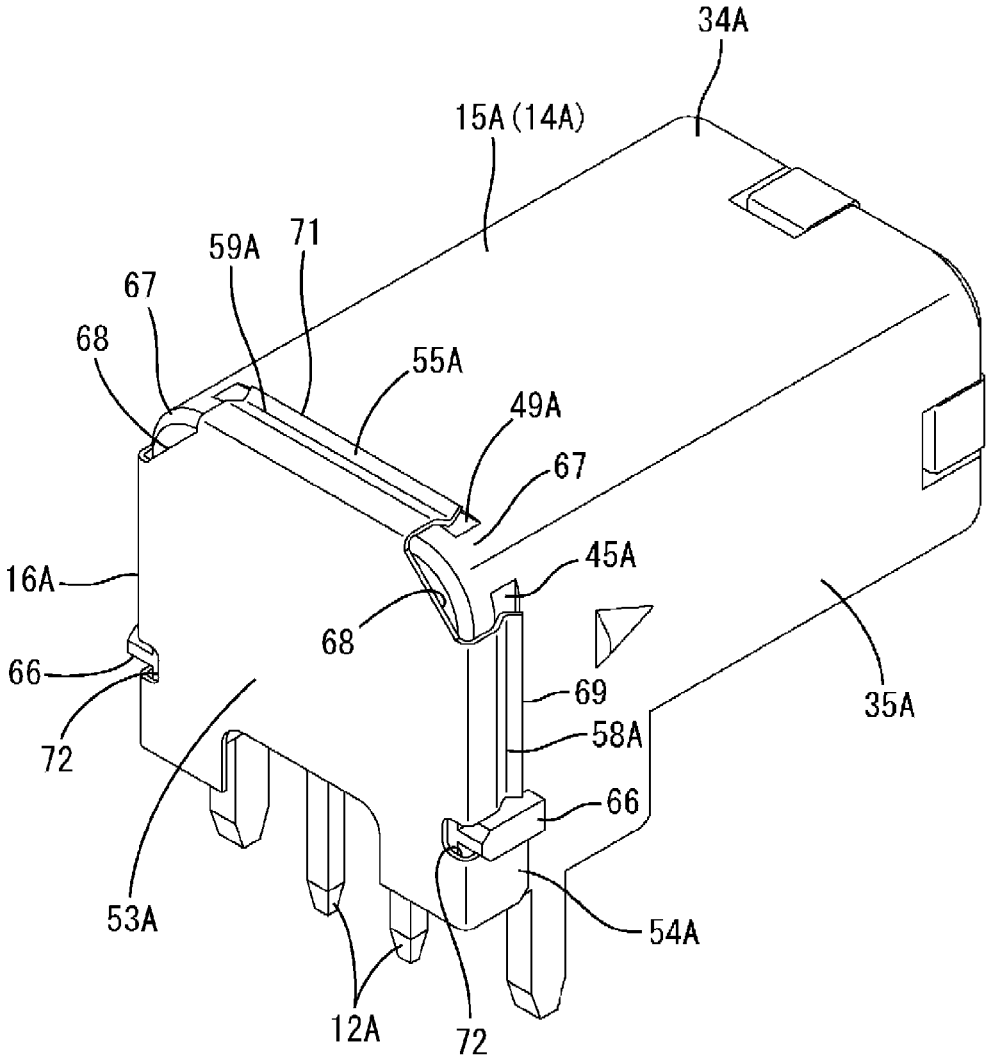
FIG. 19 is a view, equivalent to FIG. 15, of a shield connector of a second embodiment.
Figure 20:
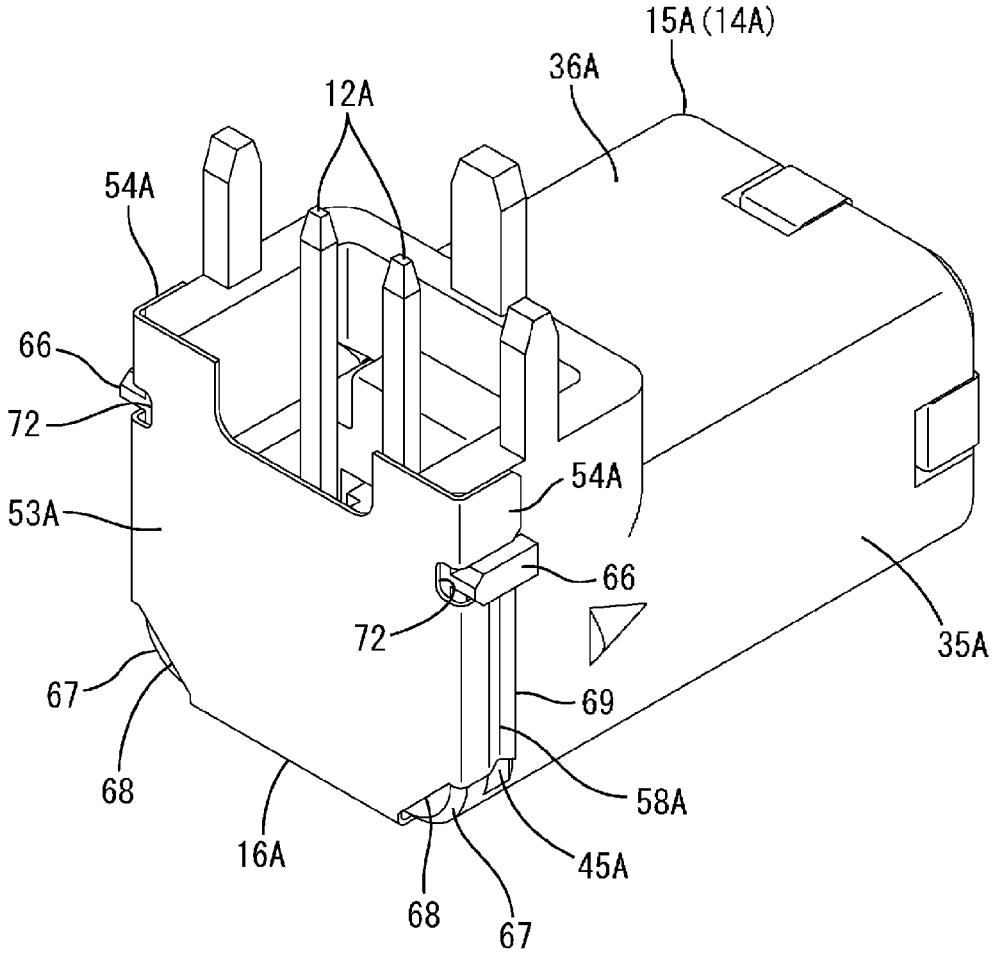
FIG. 20 is a view, equivalent to FIG. 16, of the shield connector of the second embodiment.

FIGS. 19 and 20 show an outer conductor terminal 14A of a second embodiment. The outer conductor terminal 14A is made of metal and composed of an outer conductor terminal body 15A and a lid member 16A separate from the outer conductor terminal body 15A as in the first embodiment, and the shapes of the outer conductor terminal body 15A and the lid member 16A are different from those of the first embodiment.

The outer conductor terminal body 15A has the same basic structure as the outer conductor terminal body 15 of the first embodiment, includes a ceiling plate portion 34A, a pair of side plate portions 35A and a bottom plate portion 36A and includes a dielectric accommodating portion (not shown) penetrating in a front-rear direction inside. The outer conductor terminal body 15A is not formed by press-working like the outer conductor terminal body 15 of the first embodiment, but formed by casting, forging or cutting. Thus, the outer conductor terminal body 15A has no mating end part, is continuous without any cut over an entire periphery and has a structure excellent in shielding performance.

The outer conductor terminal body 15A includes a pair of groove-like lock receiving portions 45A extending in a vertical direction in rear parts of the outer surfaces of the respective side plate portions 35 and includes rib-like protrusions 66 extending in the front-rear direction to be perpendicular to the lock receiving portions 45A on the lower ends of the lock receiving portions 45A.

Further, the outer conductor terminal body 15A includes a groove-like second lock receiving portion 49A extending in a width direction in a rear part of the outer surface of the ceiling plate portion 34A. Corner portions 67 on both ends of a rear part of the outer conductor terminal body 15A are interposed between both ends of the second lock receiving portions 49A and the upper ends of the respective lock receiving portions 45A.

The lid member 16A integrally includes a back portion 53A in the form of a flat plate capable of covering an entire insertion opening (not shown) of the outer conductor terminal body 15A, a pair of side portions 54A in the form of bent plates projecting forward a short distance from both ends of the back portion 53A and capable of covering the outer surfaces of rear parts of the respective side plate portions 35A of the outer conductor terminal body 15A, and a covering portion 55A in the form of a bent plate projecting forward a short distance from the upper end of the back portion 53A and capable of covering a rear part of the outer surface of the ceiling plate portion 34A of the outer conductor terminal body 15A. Here, since the lid member 16A is a pressed article, the lid member 16 is formed to be thinner than the outer conductor terminal body 15A, which is a cast article or the like.

The respective side portions MA and the covering portion 55A are made deflectable and deformable with coupled parts to the back portions 53A as fulcrums, and a pair of cut-like escaping portions 68 for allowing the deflection of the both are provided between the respective side portions MA and the covering portion 55A. The respective escaping portions 66 of the lid member 16A are arranged to correspond to the corner portions 67 of the outer conductor terminal body 15A.

The respective side portions MA includes a pair of locking portions 58A bent inward into a V shape on projecting end parts, and guiding portions 69 expanded from the respective locking portions 58A to tips. Similarly, the covering portion 55A includes a second locking portion 59A bent inward into a V shape on a projecting end part, and a second guiding portion 71 expanded from the second locking portion 59A to a tip. Further, the respective side portions MA include fitting grooves 72 extending in the front-rear direction to be perpendicular to the locking portions 58A and the guiding portions 69 and penetrating through both ends of the back portion 53A on the lower ends of the locking portions 58A and the guiding portions 69.

In assembling, after a dielectric is accommodated into a dielectric accommodating portion 38A of the outer conductor terminal body 15A, the lid member 16A is put on the outer conductor terminal body 15A from behind. In a mounting process of the lid member 16, the respective side portions MA and the covering portion 55A respectively slide on the outer surface of the rear part of the outer conductor terminal body 15A to be deflected and deformed while being guided by the guiding portions 69 and the second guiding portion 71. If the lid member 16A is properly externally fit on the outer conductor terminal body 15A, the respective side portions MA and the covering portion 55A resiliently return and the respective locking portions 58A and the second locking portion 59A are substantially simultaneously fit and locked to the respective lock receiving portions 45A and the second lock receiving portion 49A. In this way, the lid member 16 is stably held on the rear part of the outer conductor terminal body 15A. Further, the respective protrusions 66 of the outer conductor terminal body 15A are fit and inserted into the respective fitting grooves 72 of the lid member 16A along the front-rear direction, whereby the lid member 16A is restricted from being displaced to incline along the rear end surface of the outer conductor terminal body 15A.

In the case of the second embodiment, the outer conductor terminal body 15A is accommodated into a terminal accommodating portion 26 of a housing 13 (see FIG. 3 of the first embodiment), each inner conductor terminal 12A is solder-connected to a conductive path of a circuit board and, after a connected state of each inner conductor terminal 12A is inspected, the lid member 16A can be mounted on the rear part of the outer conductor terminal body 15A from behind. Note that each inner conductor terminal 12A of the second embodiment extends straight downward unlike each inner conductor terminal 12 of the first embodiment, and is inserted into a through hole of the circuit board and solder-connected.

Other Embodiments

The embodiments disclosed this time should be considered to be illustrative in all aspects, rather than restrictive. For example, the following embodiments can be employed.

(1) Each locking portion may be formed into a bottomed or bottomless recess in the corresponding side portion of the lid member, and each lock receiving portion may be formed to project to be lockable to each locking portion on the corresponding side plate portion of the outer conductor terminal body.

(2) The second locking portion may be formed into a bottomed or bottomless recess in the covering portion, and the second locking portion may be formed to project to be lockable to the second locking portion on the projecting piece and the ceiling plate portion.

(3) The lid member may be formed by forging, casting or cutting.

LIST OF REFERENCE NUMERALS

10 . . . shield connector
11 . . . dielectric
12, 12A . . . inner conductor terminal
13 . . . housing
14, 14A . . . outer conductor terminal
15, 15A . . . outer conductor terminal body
16, 16A . . . lid member
17 . . . dielectric body
18 . . . guide portion
19 . . . mounting hole
21 . . . dielectric locking portion
22 . . . first connecting portion
23 . . . second connecting portion
24 . . . third connecting portion
25 . . . projection
26 . . . terminal accommodating portion
27 . . . housing base portion
28 . . . receptacle
29 . . . lock portion
30 . . . fixture
31 . . . outer conductor lock receiving portion
32 . . . protection wall
33 . . . fixture mounting groove
34, 34A . . . ceiling plate portion
35, 35A . . . side plate portion
36, 36A . . . bottom plate portion
37 . . . mating end part
38, 38A . . . dielectric accommodating portion
39 . . . dielectric lock receiving portion
41 . . . insertion opening
42 . . . outer conductor locking portion
43 . . . resilient contact piece
44 . . . embossed portion
45, 45A . . . lock receiving portion
46 . . . cut portion
47 . . . projecting piece
48 . . . connecting piece
49, 49A . . . second lock receiving portion
51 . . . large area portion
52 . . . small area portion
53, 53A . . . back portion
54, 54A . . . side portion
55, 55A . . . covering portion
56 . . . first piece
57 . . . second piece
58, 58A . . . locking portion
59, 59A . . . second locking portion
61 . . . long portion
62 . . . short portion
63 . . . step portion
64 . . . stepped space
66 . . . protrusion
67 . . . corner portion
68 . . . escaping portion
69 . . . guiding portion
71 . . . second guiding portion
72 . . . fitting groove
77 . . . mating end part
78 . . . wall portion
90 . . . circuit board

What is claimed is:

1. A shield connector, comprising:

an inner conductor terminal;

a dielectric for accommodating the inner conductor terminal;

an outer conductor terminal for accommodating the dielectric; and a housing including a terminal accommodating portion, wherein:

the outer conductor terminal includes an outer conductor terminal body having an insertion opening for the dielectric in a rear surface, and a lid member separate from the outer conductor terminal body and to be mounted into the outer conductor terminal body, the outer conductor terminal body includes a lock receiving portion on each side surface, the lid member includes a back portion for covering the insertion opening, a pair of side portions connected to the back portion and configured to cover the respective side surfaces of the outer conductor terminal body, and locking portions provided on the pair of side portions and to be locked to the lock receiving portions, the housing includes a pair of outer conductor lock receiving portions on both side surfaces of the terminal accommodating portion, the outer conductor terminal body includes outer conductor locking portions projecting outward in front of the lock receiving portions on the respective side surfaces, and the outer conductor terminal is retained and held in the terminal accommodating portion of the housing by locking of the outer conductor locking portions and the outer conductor lock receiving portions.

2. An outer conductor terminal provided in the shield connector of claim 1.

3. A shield connector, comprising:

an inner conductor terminal;

a dielectric for accommodating the inner conductor terminal; and an outer conductor terminal for accommodating the dielectric, wherein:

the outer conductor terminal includes an outer conductor terminal body having an insertion opening for the dielectric in a rear surface, and a lid member separate from the outer conductor terminal body and to be mounted into the outer conductor terminal body, the outer conductor terminal body includes a lock receiving portion on each side surface, the lid member includes a back portion for covering the insertion opening, a pair of side portions connected to the back portion and configured to cover the respective side surfaces of the outer conductor terminal body, and locking portions provided on the pair of side portions and to be locked to the lock receiving portions, the outer conductor terminal body includes a second lock receiving portion on a surface other than the respective side surfaces, and the lid member includes a covering portion for covering the surface of the lid member other than the respective side surfaces and a second locking portion provided on the covering portion and to be locked to the second lock receiving portion.

4. The shield connector of claim 3, wherein the covering portion is provided to extend between the pair of side portions.

* * * * *